US007781688B2

(12) United States Patent
Regen et al.

(10) Patent No.: US 7,781,688 B2
(45) Date of Patent: Aug. 24, 2010

(54) SYSTEM AND METHOD FOR ILLUMINATING A KEYBOARD OR KEYPAD INPUT DEVICE

(75) Inventors: Paul Regen, Felton, CA (US); Peter Garrett, Aptos, CA (US)

(73) Assignee: Legacy IP LLC, San Jose, CA (US)

( * ) Notice: Subject to any disclaimer, the term of this patent is extended or adjusted under 35 U.S.C. 154(b) by 192 days.

(21) Appl. No.: 11/873,756

(22) Filed: Oct. 17, 2007

(65) Prior Publication Data

US 2008/0257698 A1 Oct. 23, 2008

Related U.S. Application Data

(60) Provisional application No. 60/852,203, filed on Oct. 17, 2006.

(51) Int. Cl.
*H01H 9/00* (2006.01)

(52) U.S. Cl. ..... 200/314; 200/310

(58) Field of Classification Search ..... 200/310, 200/313, 314
See application file for complete search history.

(56) References Cited

U.S. PATENT DOCUMENTS

| | | | | |
|---|---|---|---|---|
| 6,246,169 | B1 * | 6/2001 | Pruvot | 313/506 |
| 6,373,008 | B1 * | 4/2002 | Saito et al. | 200/310 |
| 6,765,503 | B1 * | 7/2004 | Chan et al. | 341/22 |
| 6,860,612 | B2 * | 3/2005 | Chiang et al. | 362/29 |

* cited by examiner

*Primary Examiner*—Kyung Lee
(74) *Attorney, Agent, or Firm*—Donald R. Boys; Central Coast Patent Agency, Inc

(57) ABSTRACT

An illuminated keyboard has at least one key carried by a support structure and operable to close an electrical contact on being depressed from above, the at least one key having a translucent top surface, a hollow space under the translucent top surface, and an opening into the hollow space other than through the top surface, and an electroluminescent illuminator comprising a region of electroluminescent material enabled to be inserted into the hollow space through the opening.

10 Claims, 6 Drawing Sheets

SYSTEM AND METHOD FOR ILLUMINATING A KEYBOARD OR KEYPAD INPUT DEVICE

CROSS-REFERENCE TO RELATED APPLICATIONS

The present invention claims priority to a U.S. provisional patent application Ser. No. 60/852,203 filed on Oct. 17, 2006, disclosure of which is incorporated herein by reference.

BACKGROUND OF THE INVENTION

1. Field of the Invention

The present invention is in the field of computer input devices and pertains particularly to illumination of individual keys of a computer input device such as a keyboard or keypad.

2. Discussion of the State of the Art

Advances in illumination technology have led to a variety of types of backlighting techniques for consumer electronics. One application for illumination technology is illuminating keyboards so that the keys are discernable under low-light or no light conditions.

Typically, for more advanced products an electro-luminescent (EL) sheet is used as a low power source of illumination. An EL sheet or panel, sometimes referred to as a lamp, is a flexible translucent polymer sheet containing electrical leads and conductive surface areas treated with coatings of phosphorous or other chemicals that illuminate when exposed to an electrical charge from a power source.

The inventor is aware of a method and apparatus taught by Andrew J. Katrinecz U.S. Pat. No. 6,199,996 entitled "Low Power, Low Cost Illuminated Keyboards and Keypads" hereinafter termed Andrew et al. Andrew et al illustrates manufacturing processes for non-illuminated data-entry devices and mice to the manufacture of illuminated data-entry devices. The method calls for luminescent sheets of one or more colors integrated into a typical manufacturing process for keyboards whereby the sheet is incorporated underlying optically translucent device components to provide illumination of the components visual to a user of the device. The optically translucent components may be doped with phosphors or tinted to provide components that emit light of different colors. The intensity of illumination of the luminescent sheet may be controlled by the user and may vary in response to the background light of the environment.

Although illumination may be adequately produced from the source EL sheet of Andrew, the mechanics of the keyboard and more importantly the keys render the illumination effect produced undesirable in that shadows attributed to overlying keyboard components hinder a user's ability to well discern the correct key characters printed on the key faces above the illumination panel.

The general problem is that the illumination panel is setting to far below the face of the keys and therefore, parallax happens where one cannot see the characters well enough because of shadowing from the underlying mechanics of the keys set above the illumination or EL panel.

Therefore what is clearly needed is a system and method for illuminating the keyboard or keypad in a way that eliminates any parallax or shadowing from key components or other elements of the keyboard architecture.

SUMMARY OF THE INVENTION

In a preferred embodiment of the present invention an illuminated keyboard is provided, comprising at least one key carried by a support structure and operable to close an electrical contact on being depressed from above, the at least one key having a translucent top surface, a hollow space under the translucent top surface, and an opening into the hollow space other than through the top surface, and an electroluminescent illuminator comprising a region of electroluminescent material enabled to be inserted into the hollow space through the opening.

In one embodiment the keyboard comprises a plurality of keys having translucent top surfaces and open at a bottom extremity providing the opening, the keys arranged in a fixed pattern and guided in operation, and overlying a panel having electroluminescent regions arranged to underlie each of the plurality of keys.

Also in an embodiment the electroluminescent regions are individual extensions from the panel enabled to be inserted through openings in individual keys into the hollow space of each. The support structure may be a keypad of one of a computer keyboard, a keypad on a cellular telephone or a keypad on a personal digital assistant.

In some embodiments the fixed pattern comprises separate rows of keys, and a plurality of separate electroluminescent panels, powered by a common connection, one provided for each row of keys.

In another aspect of the invention a method is provided for illuminating a keyboard, comprising the steps of (a) supporting at least one key from a support structure, the key operable to close an electrical contact on being depressed from above, the at least one key having a translucent top surface, a hollow space under the translucent top surface, and an opening into the hollow space other than through the top surface; and (b) inserting a region of electroluminescent material from an electroluminescent illuminator panel into the hollow space through the opening.

In some embodiments in step (a) a plurality of keys are arranged in a fixed pattern and supported to be illuminated, and in step (b) a panel having electroluminescent regions underlies each of the plurality of keys. In some embodiments the electroluminescent regions are individual extensions from the panel enabled to be inserted through openings in individual keys into the hollow space of each. Also in some embodiments the support structure is a keypad of one of a computer keyboard, a keypad on a cellular telephone or a keypad on a personal digital assistant. In still another embodiment the fixed pattern comprises separate rows of keys, and comprises also a plurality of separate electroluminescent panels, powered by a common connection, one provided for each row of keys.

BRIEF DESCRIPTION OF THE DRAWING FIGURES

FIG. 2 is an elevation view of a row of electroluminescent keys with an electroluminescent panel strip threaded there through.

DETAILED DESCRIPTION

Figure 1:
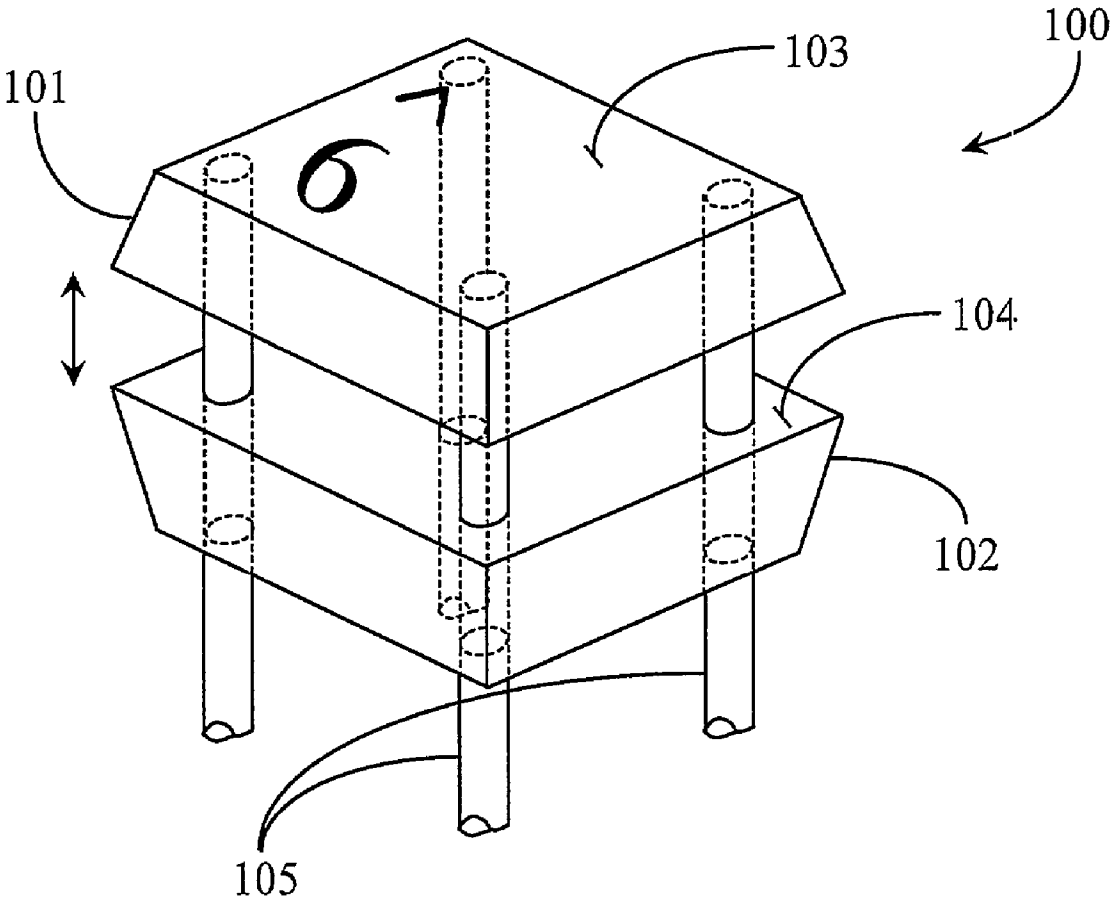
FIG. 1 is a perspective view of a translucent key of a keyboard or keypad adaptable for electroluminescence according to an embodiment of the present invention.

FIG. 1 is a perspective view of translucent key 100 adaptable for a keyboard or keypad adaptable for electroluminescence according to an embodiment of the present invention. Key 100 includes a key top portion 101 and a key bottom portion 102. Top portion 101 may be manufactured of a translucent or slightly opaque polymer that is rigid or semi-rigid in finished composition. Key top portion 101 has a top surface 103 on which one or more key characters and or symbols are printed, preferably in a dark color such that adequate contrast under key illumination is presented to a user.

Top portion 101 has a hollowed interior and four side walls and is generally symmetric and trapezoidal in geometric shape from an elevation perspective in this embodiment. From an overhead perspective, the key top portion is substantially rectangular. Other shapes may be presented without departing from the spirit and scope of the invention. In this embodiment, the key illustrated is the number 6 key of a traditional input keyboard for a laptop or desktop computer. Other like keys aggregated and making up the total keyboard or keypad keys of an electronic device will have the appropriate printings indicating which key is which in a key array.

It is only required that the top surface 103 of key 100 be translucent, however, the entire key may be fabricated of translucent materials such as a clear or slightly opaque polymer material. Key top portion 101 and key bottom portion 102 are vertically aligned in this embodiment and are separable from one another. Bottom portion 102 need not be of the same geometric shape as top portion 101, for example, an inverted trapezoid. The bottom portion may be rectangular in elevation profile while the top portion may remain trapezoidal in elevation profile. In this case both portions have the same dimensions and are diametrically opposed in alignment with one another. This consideration is simply a matter of design preference.

Key bottom portion 102 may or may not include a hollowed interior. In one embodiment bottom portion 102 may be a solid key-base. Like top portion 101, bottom portion 102 may be fabricated of a translucent polymer; however any solid color polymer material may be used. For example, bottom portion 102 may include a solid top plate 104 translucent or not. Bottom portion 102 does not require a hollowed interior, though one may be provided. In the case of a hollowed interior in the bottom portion 102 of key 100, at least one opening may be provided through a one or opposing walls of the bottom portion such that the interior thereof is accessible from opposing sides of the key body. In this embodiment it is not specifically required because top portion 101 has a hollowed interior and it is accessible via a space between the two key portions when the key is not being depressed.

Key portions 101 and 102 are held in alignment by two or more (in this case 4) plunger posts 105. Posts 105 extend up through the bottom portion 102 of key 100 through openings ordered in a symmetrical pattern and adapted for the purpose. Bottom portion 102 is not affixed in any way to posts 105 and posts 105 may slide freely through the openings provided. The top ends of posts 105 extend to and are affixed to or seated against the underside of the top surface wall 103 of top portion 101 such that when one presses down on surface 103, the key may be depressed downward until it abuts with the bottom portion 102. When one releases the downward force, the top portion returns to the original position. Plunger posts 105 provide a spring tensioned modality to top portion 101 of key 100. Springs or other mechanisms not shown may be provided and housed between the key portions or between the plunger post bottom ends and circuit board hardware. The act of pressing key 100 results in registry of the key's input on the host computing device as is the case with traditional keys.

In one embodiment of the invention, surface 104 may support an electroluminescent panel (EL) strip or tab arranged such that the side of illumination of the strip or tab faces upward underneath translucent surface 103 thereby providing illumination to key 100 above the plane of any shadow-inducing hardware. In one case, an EL strip may be supported directly on surface 104 in congruence with a row of keys arrayed on a keyboard or keypad. In another case one EL panel may have EL tabs provided therein and strategically placed to intersect with the appropriate keys of a keyboard or keypad being adapted for illumination such that the tab ends may be inserted into individual ones of the keys with the illumination side of the tab facing toward surface 103.

Figure 2:
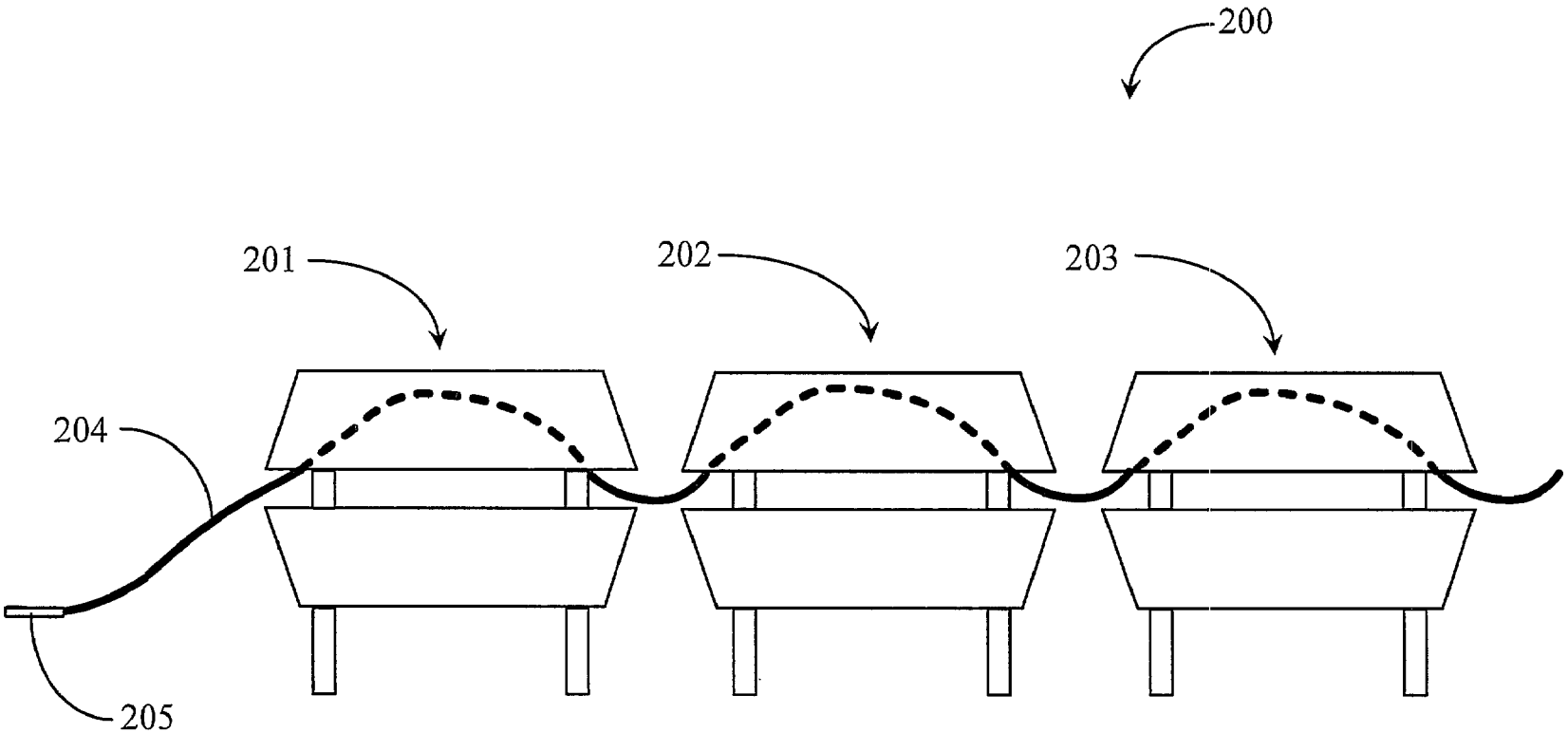

FIG. 2 is an elevation view of a row 200 of electroluminescent keys with an electroluminescent panel strip threaded therethrough. Key row 200 includes a key 201, a key 202, and a key 203 for illustrative purpose. Keys 200-203 are analogous in construction and materials to key 100 described further above. They are given separate element numbers based only on designation by what may be printed on the key surfaces in a portion of a particular row of keys such as might be found on a keyboard or keypad. For example, key 200 may be the A key followed by the S key followed by the D key on a typical keyboard row.

In this example the keys are illuminated by an EL strip 204 having an electric lead 205 that may be soldered or otherwise connected to the appropriate power leads on a circuit board. In this example, EL strip 204 is threaded through keys 201, 202, and 203 in approximately a sine wave pattern to allow for slack in key depression. The luminescent side of EL strip 204 faces upward, thereby illuminating each of keys 201, 202, and 203 in the row. There may be 6 or more strips fashioned for a keyboard having 6 rows of keys to be illuminated, for example. The strips 204 may be provided in a single EL sheet having one electrical connection to the circuit board for power such that each of the strips illuminates when power id provided to lead 205. Alternatively, completely separate EL strips may be provided and chained together electrically at one junction point with the circuit board of the device.

Figure 3:
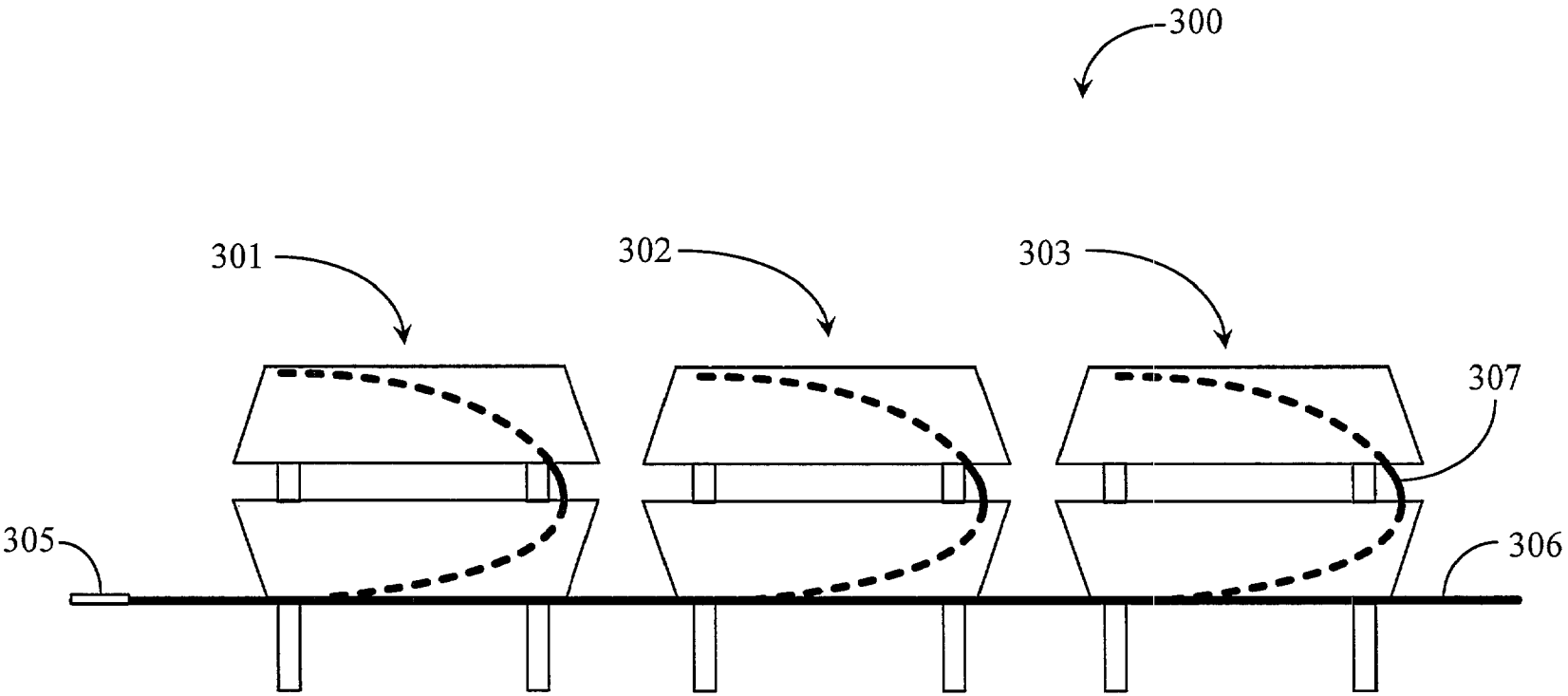
FIG. 3 is an elevation view of a row of electroluminescent keys with electroluminescent tabs of an electroluminescent panel inserted therein.

FIG. 3 is an elevation view of a row 300 of electroluminescent keys with electroluminescent tabs of an electroluminescent panel inserted therein. Row 300 includes keys 301, 302, and 303. Keys 301-303 are analogous in construction and materials to key 100 described further above except that the bottom portions of the keys have an opening (not illustrated) provided beneath, giving access to a hollowed interior inherent to the bottom portion of each key.

In this embodiment, an EL sheet or panel 306 is provided having an electrical lead 305 adapted to receive power from a host device. EL sheet 306 is disposed beneath the bottoms of keys 301-303. Portions of EL panel 306 are formed into tabs 307 that may be disposed upward from the plane of the panel and the ends of which may be inserted into associative keys. The tabs 307 are formed strategically for each key in each row to be illuminated so that there is an EL tab for each key in an array.

In this embodiment, the illumination side of the EL panel faces downward but due to the position of each inserted tab 307 turns upward with insertion and faces the top surface of the keys. In one embodiment only the tab surfaces of the panel are treated with florescent chemical so that illumination is centered within each key. One panel may be provided with as many strategically placed tabs as might be required to facilitate a particular key array.

Figure 4:
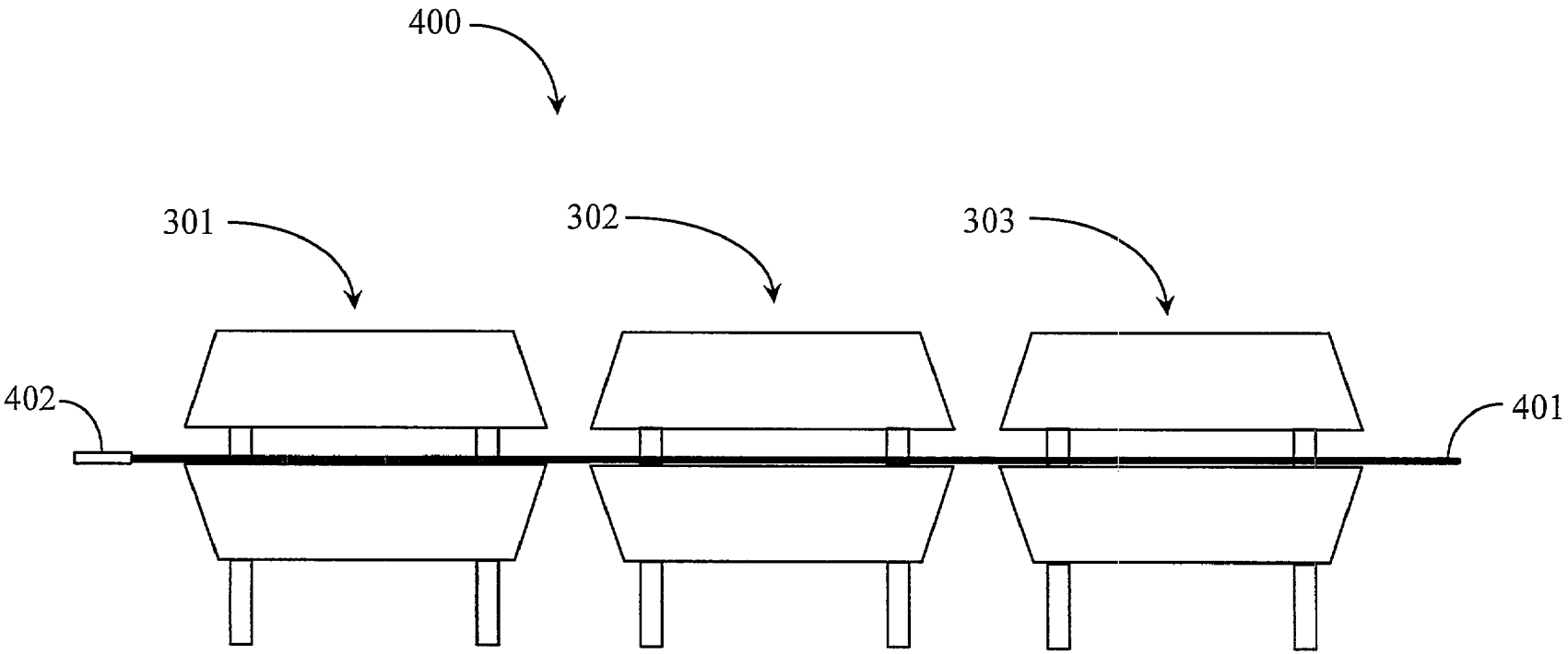
FIG. 4 is an elevation view of a row of electroluminescent keys with an electroluminescent strip disposed in between key segments.

FIG. 4 is an elevation view of a row 400 of electroluminescent keys with an electroluminescent strip disposed in between key segments. Row 400 includes keys 301-303 as described with respect to FIG. 3 above. In this example, however, an EL sheet 401 is disposed linearly in sheet form on a plane in between the top and bottom portions of keys 301-303. EL panel 401 has a lead 402 adapted to receive power for charging the sheet for illumination. In this case, the EL sheet has openings provided therethrough in a strategic pattern to accommodate the plunger posts of each key in a key array. EL sheet 401 has no strips or tabs and the illumination side of the strip faces upward thereby illuminating the keys when charged.

In this embodiment, a single sheet may be fabricated in the shape and key pattern of an entire keyboard or keypad and is installed over the key bottom portions of the keys over the plunger posts, the openings in the sheet aligning with the plunger posts. The top portions of keys 301-303 may then be installed or seated to the upper post ends such as by press fit or gluing.

Figure 5:
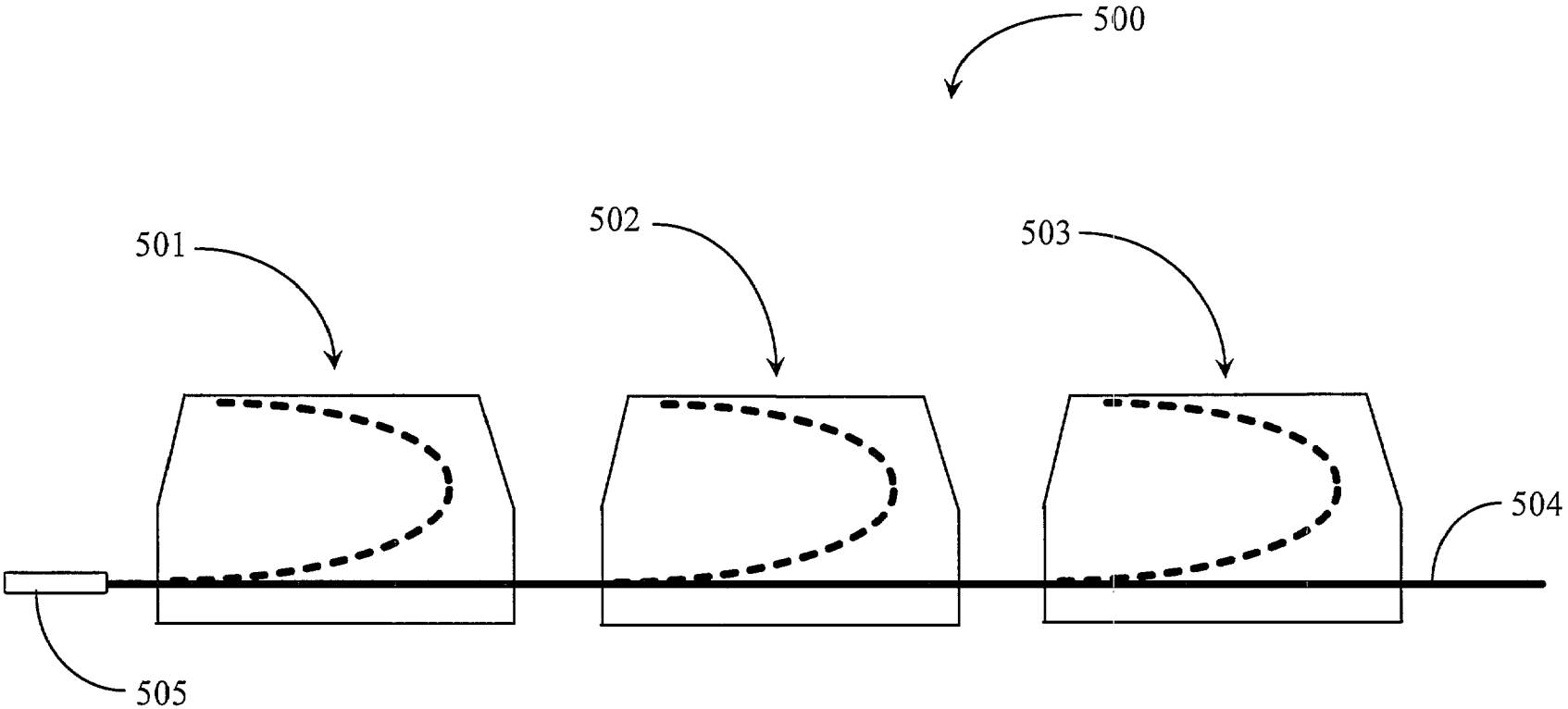
FIG. 5 is an elevation view of a row of electroluminescent keys of single body having tabs of an electroluminescent panel inserted therein.

FIG. 5 is an elevation view of a row 500 of electroluminescent keys of single body construction having tabs of an electroluminescent panel inserted therein. Row 500 includes keys 501-503. Keys 501-503 are in this embodiment, single bodied keys meaning that they do not have top or bottom key portions.

Such keys may be formed or molded of a single translucent polymer material that may be rigid or semi-rigid depending on the key depression architecture planned. For example, key plungers may be affixed to the bottom of a rigid or semi-rigid key so that the key is depressed and moves in whole to register a keystroke. Keys 501-503 have hollow interiors to enable insertion of the EL tabs.

This embodiment is like that of the embodiment of FIG. 3 accept that the keys are single bodied with an opening provided for inserting EL tabs. The illumination side of the tabs faces upward when inserted as illustrated. The keys are hollow and the tab curls up and around in the same way as it does with the segmented keys.

It will be apparent to one with skill in the art that other embodiments may be conceived with respect to varying key architecture and EL panel configuration without departing from the spirit and scope of the present invention. For example, instead of placing the tab insert openings on a side wall, they may be provided on the underside wall of each key. Moreover, an EL strip embodiment may also be implemented with single bodied keys having openings on both key sides to thread the strip through the key.

Figure 6:
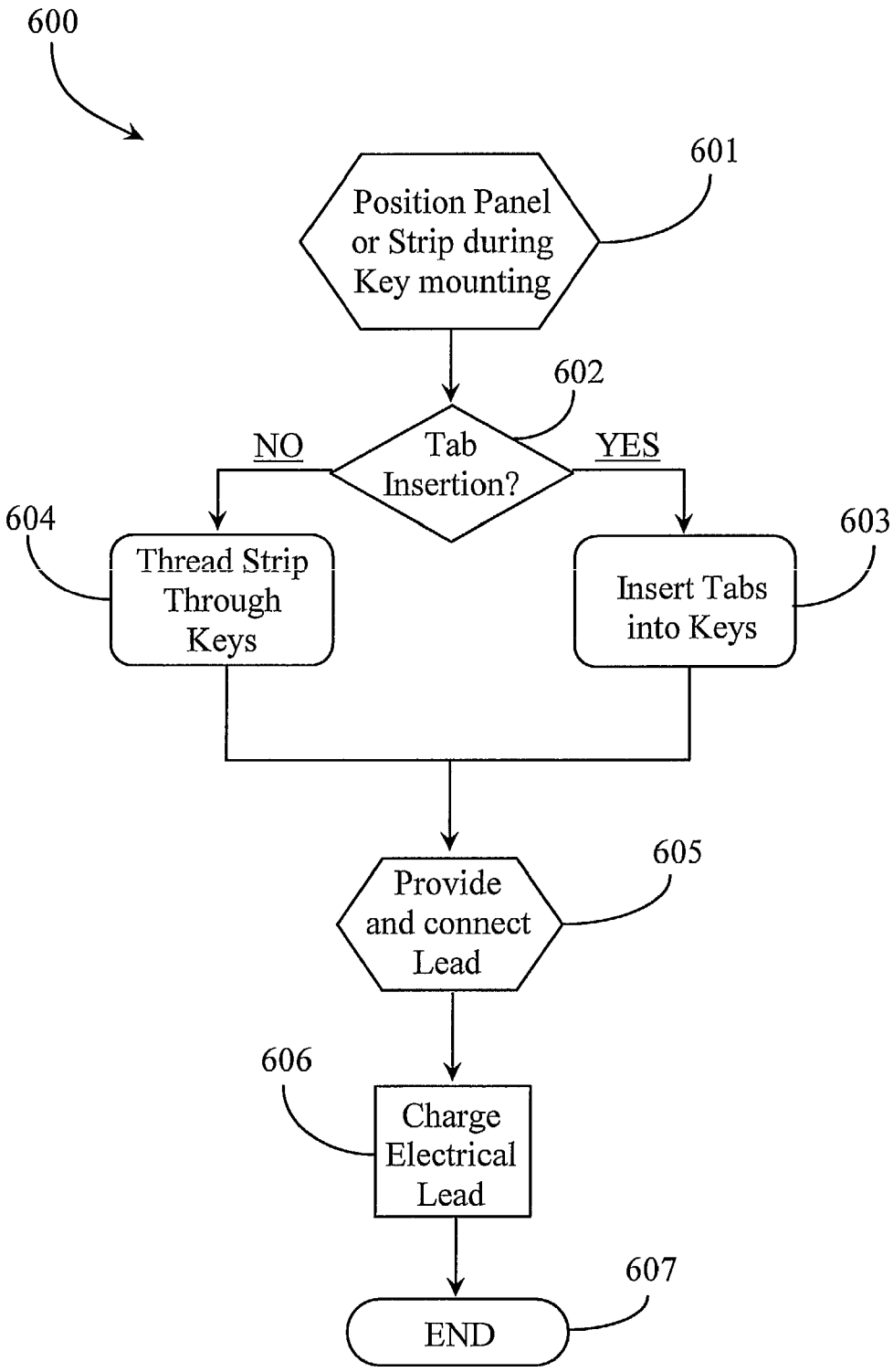
FIG. 6 is a process flow chart illustrating steps for illumination a key of a keyboard or keypad.

FIG. 6 is a process flow chart illustrating steps 600 for illuminating a key of a keyboard or keypad. At step 601, an EL panel or sheet is positioned in place during key mounting of the keys of a keyboard or keypad. According to design variation, the EL sheet may be a single sheet sporting tabs or strips, or it may be a single sheet disposed between top and bottom key portions. In one case, separate strips may be provided for each row of keys.

In this case, the process assumes the presence of tabs or strips in the EL panel or sheet. At step 602 it is determined if tab insertion will be implemented. At step 602 if tabs are present then at step 603, the tabs are inserted free end first into the individual associated keys. If at step 602, no tabs are present then it is assumed that strips are present for each key row. In this case, at step 604, the strips are threaded through the keys linearly down each row.

In either case, at step 605 the electrical lead is provided and connected for enabling power to charge the EL sheet. At step 606, the EL sheet is charged illuminating the strip or tab surfaces thereby illuminating the keys of the keyboard or keypad.

In one embodiment, the process uses a single EL sheet with no strips or tabs. In this case, steps 602, 603, and 604 are not required and are replaced by a step for placing the EL sheet into position over plunger posts of the keys with the tops off. Then a step is provided for seating the key tops to the plunger post tops to finish the installation. The process in this case then resumes with step 606. The process ends at step 607.

It will be apparent to one with skill in the art that the keyboard or keypad illumination system of the invention may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

What is claimed is:

1. An illuminated keyboard, comprising:

at least one key carried by a support structure and operable to close an electrical contact on being depressed from above, the at least one key having a translucent top surface, a hollow space under the translucent top surface, and an opening into the hollow space other than through the top surface; and an electroluminescent illuminator comprising a region of electroluminescent material enabled to be inserted into the hollow space through the opening.

2. The keyboard of claim 1 comprising a plurality of keys having translucent top surfaces and open at a bottom extremity providing the opening, the keys arranged in a fixed pattern and guided in operation, and overlying a panel having electroluminescent regions arranged to underlie each of the plurality of keys.

3. The keyboard of claim 2 wherein the electroluminescent regions are individual extensions from the panel enabled to be inserted through openings in individual keys into the hollow space of each.

4. The keyboard of claim 2, wherein the support structure is a keypad of one of a computer keyboard, a keypad on a cellular telephone or a keypad on a personal digital assistant.

5. The keyboard of claim 2, wherein the fixed pattern comprises separate rows of keys, and comprising a plurality of separate electroluminescent panels, powered by a common connection, one provided for each row of keys.

6. A method for illuminating a keyboard, comprising the steps of:

(a) Supporting at least one key from a support structure, the key operable to close an electrical contact on being depressed from above, the at least one key having a translucent top surface, a hollow space under the translucent top surface, and an opening into the hollow space other than through the top surface; and (b) inserting a region of electroluminescent material from an electroluminescent illuminator panel into the hollow space through the opening.

7. The method of claim 6 wherein in step (a) a plurality of keys arranged in a fixed pattern are supported to be illuminated, and in step (b) a panel having electroluminescent regions underlies each of the plurality of keys.

8. The method of claim 7 wherein the electroluminescent regions are individual extensions from the panel enabled to be inserted through openings in individual keys into the hollow space of each.

9. The method of claim 7, wherein the support structure is a keypad of one of a computer keyboard, a keypad on a cellular telephone or a keypad on a personal digital assistant.

10. The keyboard of claim 7, wherein the fixed pattern comprises separate rows of keys, and comprising a plurality of separate electroluminescent panels, powered by a common connection, one provided for each row of keys.

* * * * *